United States Patent [19]

Hefftler et al.

[11] Patent Number: 4,811,663

[45] Date of Patent: Mar. 14, 1989

[54] DRIVING SYSTEM FOR SHEET-FED ROTARY PRINTING MACHINE

[75] Inventors: Victor Hefftler, Coswig; Hans Johne, Radebeul; Horst Schulz, Dresden; Arndt Jentzsch, Coswig; Helmut Schöne, Radebeul, all of German Democratic Rep.

[73] Assignee: Veb Kombinat Polygraph "Werner Lamberz" Leipzig, Leipzig, German Democratic Rep.

[21] Appl. No.: 947,025

[22] Filed: Dec. 29, 1986

[30] Foreign Application Priority Data

Dec. 27, 1985 [DD] German Democratic Rep. ... 285548

[51] Int. Cl.[4] ..... B41F 13/00; B41F 7/00

[52] U.S. Cl. ..... 101/183; 101/DIG. 35

[58] Field of Search ..... 101/183, 184, 180, 181, 101/DIG. 11

[56] References Cited

U.S. PATENT DOCUMENTS

| | | | |
|---|---|---|---|
| 2,707,914 | 5/1955 | Harrold | 101/183 |
| 4,183,296 | 1/1980 | Rambausek | 101/183 X |

FOREIGN PATENT DOCUMENTS

| | | | |
|---|---|---|---|
| 2334177 | 1/1975 | Fed. Rep. of Germany . | |
| 2758900 | 10/1978 | Fed. Rep. of Germany | 101/183 |
| 737245 | 5/1980 | U.S.S.R. | 101/183 |
| 1183467 | 3/1970 | United Kingdom | 101/183 |

*Primary Examiner*—Clifford D. Crowder

*Attorney, Agent, or Firm*—Michael J. Striker

[57] ABSTRACT

To guarantee an exact engagement of toothed flanks in the driving gear train of a multi-color sheet-fed rotary printing machine, the gears in the train pertaining to an intermediate printing unit of the machine are power supplied from a driving member which transmit a three-fold power portion in comparison to uniform power portions transmitted by driving elements assigned to the remaining printing units.

4 Claims, 1 Drawing Sheet

DRIVING SYSTEM FOR SHEET-FED ROTARY PRINTING MACHINE

BACKGROUND OF THE INVENTION

The present invention relates to a sheet-fed rotary printing machine provided with a driving system.

From prior art, for example from the German Pat. No. 2,334,177, sheet-fed rotary printing machines are known which include a sheet feeder, a series of printing units wherein the first printing unit cooperates with the feeder and the last printing unit cooperates with a discharger for printed sheets, a gear train for interconnecting impression cylinders and transfer cylinders of respective printing units, and a driving system provided with at least one driving element for transmitting parts of driving power to the gear train.

In modern printing industry employing sheet-fed rotary printing machines, there has been trend towards more and more structural alternations of the machines in order to rationalize and increase quality of the processed order. Continuously increasing demand is for printed products of highest quality having brilliant colors whereby in one running through the machine there is produced for example a four color first printing on the front side and two colors printing on the backside followed with a surface finish by varnishing and drying the varnish and the paint coat. Due to the consistent paints and viscous varnishes employed for this purpose power input in the machine is simultaneously increased and so are the static as well as dynamic forces acting on the machine. As a result of the higher loads of such multi-color printing machines there is a tendency to develop interfering low frequency vibrations which impair particularly the quality of the sheet transfer from one printing unit to another because the engagement of the toothed flanks in the gear train of the impression cylinders and transfer cylinders is disturbed.

Therefore, it is disadvantageous that in prior art driving systems for the heavily loaded printing machines, a continuous contact or engagement between the flanks is no longer guaranteed under the beforedescribed conditions. To avoid this drawback in series connected drives an overdimensioning of the driving gears would be necessary which would result in steep increase of construction costs. In addition, in printing machines having a plurality of printing units, such as for example a ten color printing machine, it is also disadvantageous that with increasing printing power the intake printing unit and the discharging printing unit run out of register.

SUMMARY OF THE INVENTION

It is, therefore, a general object of this invention to increase the quality of printed products even under the condition of continuous requirements for an increased productivity.

In particular, it is an object of this invention to provide a sheet-fed rotary printing machine having at least three printing units, a driving system which even under a high printing output and under difficult operational conditions guarantees an almost constant power flow in all printing units inclusive of the discharging printing unit.

Still another object of this invention is to insure an exact engagement of teeth flanks in the driving gear train.

In keeping with these objects and others which will become apparent hereafter, one feature of this invention resides in the provision of means for transmitting to a driving member pertaining to an intermediate printing unit a three-fold part of driving power in comparison to the uniform parts of driving power transmitted by respective drives pertaining to the remaining printing units.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
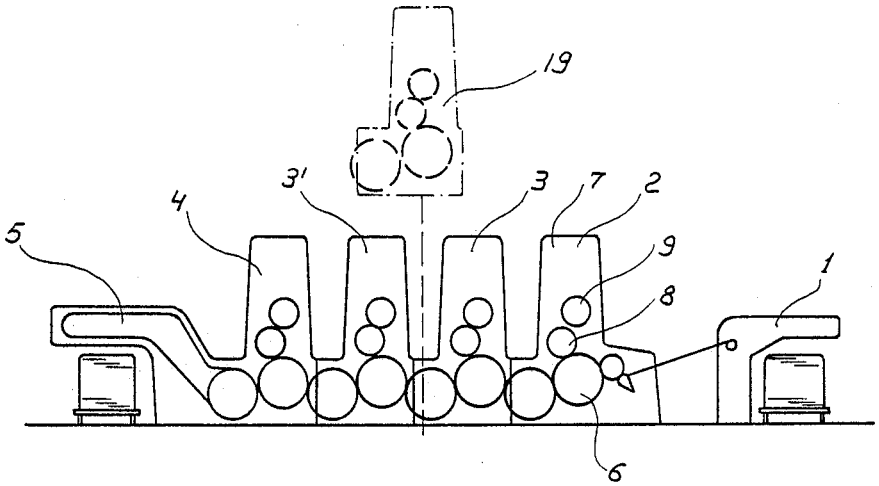
FIG. 1 shows schematically a sheet-fed four color printing machine.

FIG. 1 illustrates schematically a sheet-fed rotary printing machine of an aggregated construction modified for printing in four colors. The machine includes a feeder 1 for sheets to be printed, an intake printing unit 2 cooperating with the feeder, two intermediate printing units 3, and 3' and a final or discharging printing unit 4 cooperating with a discharger 5 for printed sheets. Each of the series of the printing units includes an impression cylinder 6, a transfer cylinder 7, a blanket or offset cylinder 8 and a plate cylinder 9.

The impression cylinder 6 and the transfer cylinder 7 of respective printing units 2, 3, 3', and 4 are interconnected by a gear train 10 which is a component part of a drive system of the printing machine. The gear train is formed by meshing gears 11 and 12 arranged on respective impression and transfer cylinders. The intermediate printing unit 3 of the machine is provided with a driving member 13 which transmits to the printing unit 3 a triple part of driving power as compared with the uniform parts of driving power transferred to the remaining printing units. The remaining intermediate printing unit 3' in the series of this example is driven by a driving member 14 which transmits to the discharging printing unit 4 a substantially uniform simple quota (25%) of driving power.

In the case of an odd number of printing units, the intermediate printing unit driven by the three-fold power is exactly the central one. For example, in a five color printing machine having an intake printing unit, three intermediate printing units and a discharging printing unit, it is the second intermediate printing unit. In the case of an even number of the printing units in a machine, the printing unit driven by the increased power is that which adjoins a center point 19 in the series of printing units, as indicated in FIG. 1 by dashed lines representing an imaginary central printing unit. In other words, in the example of FIG. 1 it is either the first or the second intermediate printing unit (3 or 3') which is driven by the three-fold power.

for the subsequent printing units and the corresponding driving members are shown in the following table:

| Printing machine modification | Central printing unit | Three-fold power for the central printing unit | Remaining printing units | One-fold power-quota for each of the remaining printing units | Driving members | |
|---|---|---|---|---|---|---|
| | | | | | No. of Motors | No. of differential gears |
| 3-color machine | 1 | $\frac{100\% \times 3}{3} = 100\%$ | 1 | — | 1 | — |
| 4-color machine | 1 or 2 | $\frac{100\% \times 3}{4} = 75\%$ | 1 or 2 | $1 \times \frac{100 \times 1}{4} = 25\%$ | 2 | 1 end differential |
| 5-color machine | 3 | $\frac{100\% \times 3}{5} = 60\%$ | 1; 3 | $2 \times \frac{100 \times 1}{5} = 20\%$ | 3 | 1 differential<br>1 end differential |
| 6-color machine | 2 or 3 | $\frac{100\% \times 3}{6} = 50\%$ | 1; 4 | $3 \times \frac{100 \times 1}{6} = 16.6\%$ | 4 | 2 differentials<br>1 end differential |

For a certain printing output the total (100%) driving power supplied to the printing machine is divided by the number of printing units inclusive of the discharging printing unit.

For a four color printing machine, the three-fold part of the driving power for the intermediate printing unit 3 or 3' is computed as follows:

$$\frac{100\% \text{ (total driving power)} \times 3}{4 \text{ (printing units of the color printing machine)}} = 75\%$$

The uniform simple power parts transmitted by driving members assigned to the remaining intermediate printing unit is computed as follow:

$$\frac{100\% \text{ (total power)} \times 1}{4 \text{ (units of the machine)}} = 25\%$$

Figure 2:
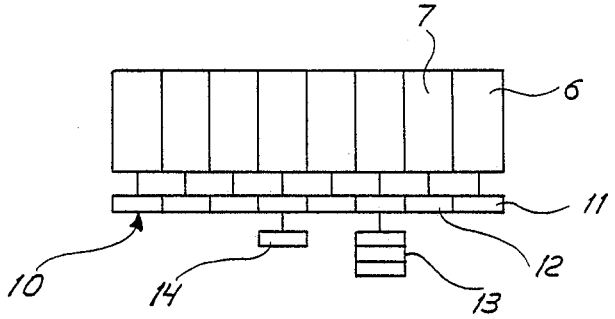
FIG. 2 is a schematic top view of an embodiment of the driving system of the printing machine of FIG. 1, employing a motor drive.

The triple power driving member 13 and the remaining simple power driving member 14 in the embodiment illustrated in FIG. 2 are in the form of separate drives, such as electrical motors or hydraulic motors. In this embodiment, the differentiated power distribution is achieved by a three-fold torque of the driving member 13 in comparison with the lower torque of the remaining driving member 14 provided that the gears in the gear train have the same rotary speed.

Figure 3:
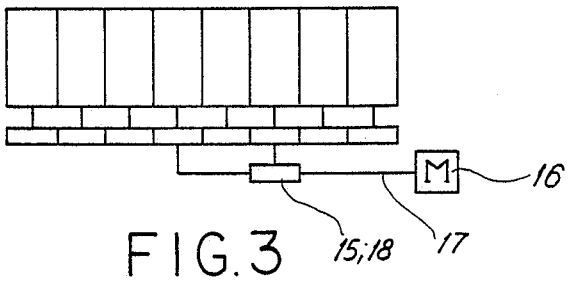
FIG. 3 is a schematic top view of another embodiment of the driving system of the machine of FIG. 1, using a differential drive.

In the embodiment of FIG. 3, there are employed conventional differential gears 15, 18 to serve as the driving members for the gear train 10. This embodiment is applicable in at least a four colors printing machine using from four printing units up. In a four colors printing machine, the driving system includes a single electric motor 16 for transmitting the total input power (100%) via a longitudinal shaft 17 and differential gears 15, 18 to the two printing units 3 and 3'. The terminal differential gear 18 drives with a lower power or torque (25%) the intermediate printing unit 3', whereby the last printing unit 4 is power driven by the intermediate printing unit 3'. In the case of a five color printing machine the terminal differential gear 18 drives with the lower torque the last printing units whereas the central printing unit (19) is driven with the three-fold torque (75%) by a differential gear 15. The power distribution according to this invention in the differential gear drive 15, 17, 18 is achieved in conventional manner by adjusting transmission ratios of the differential gears 15 and 18.

A survey of the three-fold driving power for an intermediate printing unit, the uniform lower driving power The sheet feeder 1, the first printing unit 2, the last printing unit 4 and the printed sheet discharger 5 by themselves are not driven by any additional driving member but are driven by the gear train 10 only.

The illustrated embodiments of the driving system are applicable also for the three-colors printing machines nevertheless the full effect of this invention becomes apparent only in the machine modifications having from four printing units up.

Figure 4:
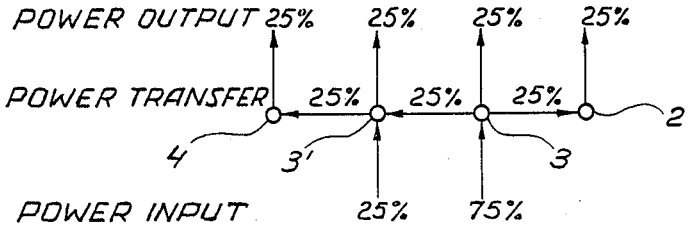
FIG. 4 is a diagram illustrating the power flow in the driving system of the machine of FIG. 1.

The operation of the sheet-fed rotary printing machine of FIGS. 1–3 will be explained with reference to the flow diagram of FIG. 4.

Total power (100%) supplied to a four-color printing machine is distributed such that one of the intermediate printing units, in this example the printing unit 3 receives 75% of the total input power whereas the remaining intermediate printing unit 3' receives 25% of the total input power. In other words, the gear assigned to the first intermediate printing unit 3 is designed for taking over three times as much of the load as each of the remaining printing units. The gear train 10 uniformly distributes the full input power of the driving system and transfers uniform power quotas (25%) in such a manner that under any operational condition of the machine, an exact and full engagement of the toothed flanks of the transmission gear train is guaranteed. At the same time, each of the printing units inclusive the last printing unit, operates at its full output power or load (25%).

What is claimed as new and desired to be protected by Letters Patent is set forth in the appended claims:

1. A sheet-fed rotary printing machine including a feeder for sheets to be printed, a series of at least four printing units wherein the first printing unit cooperates with said feeder and the last printing unit cooperates with a discharger for printed sheets, a gear train for interconnecting impression cylinders and transfer cylinders of respective printing units, and a driving system provided with a plurality of driving members for supplying a total driving power to said gear train, comprising a first driving member designed for transmitting to gears assigned to the cylinders of an intermediate printing unit immediately following said first printing unit a part of driving power which is a triple of respective power parts transmitted by the remaining driving member or members to gears assigned to cylinders of the subsequent printing units; and the total number of the driving members corresponding to the number of printing units in said series less two.

2. A rotary printing machine as defined in claim 1, wherein said remaining driving members drive printing units between the third and the last printing unit in said series.

3. A rotary printing machine as defined in claim 1, wherein said driving members are separate motors.

4. A rotary printing machine as defined in claim 1, wherein said driving system includes a driving motor for delivering a total driving power, said driving members being in the form of differential gears driven by said driving motor via a longitudinal shaft.

* * * * *